US009222662B2

(12) United States Patent
Chen

(10) Patent No.: US 9,222,662 B2
(45) Date of Patent: Dec. 29, 2015

(54) HEAT DISSIPATION MODULE AND MODULAR LIGHTING DEVICE WITH HEAT DISSIPATION MODULE

(71) Applicant: LivingStyle Enterprises Limited, Dong Guan, Guang Dong (CN)

(72) Inventor: Ming-Yun Chen, Dong Guan (CN)

(73) Assignee: LIVINGSTYLE ENTERPRISES LIMITED, Dong Guan (CN)

( * ) Notice: Subject to any disclaimer, the term of this patent is extended or adjusted under 35 U.S.C. 154(b) by 120 days.

(21) Appl. No.: 14/039,366

(22) Filed: Sep. 27, 2013

(65) Prior Publication Data

US 2014/0092602 A1 Apr. 3, 2014

(30) Foreign Application Priority Data

Sep. 29, 2012 (CN) ..... 2012 2 0511166

(51) Int. Cl.

| | |
|---|---|
| ***F21V 29/00*** | (2015.01) |
| ***F21K 99/00*** | (2010.01) |
| ***F21V 29/507*** | (2015.01) |
| ***F21V 29/70*** | (2015.01) |
| *F21Y 101/02* | (2006.01) |
| *F21Y 103/02* | (2006.01) |
| *F21V 23/04* | (2006.01) |

(52) U.S. Cl.

CPC ..... *F21V 29/22* (2013.01); *F21K 9/1355* (2013.01); *F21V 29/507* (2015.01); *F21V 29/70* (2015.01); *F21V 23/0471* (2013.01); *F21Y 2101/02* (2013.01); *F21Y 2103/022* (2013.01)

(58) Field of Classification Search

CPC ..... F21V 17/164; F21V 29/22

USPC ..... 362/373, 547

See application file for complete search history.

(56) References Cited

U.S. PATENT DOCUMENTS

| | | | | |
|---|---|---|---|---|
| 8,956,017 | B2 * | 2/2015 | Ioka et al. | 362/362 |
| 2009/0296403 | A1 * | 12/2009 | Zhang et al. | 362/294 |
| 2011/0234078 | A1 * | 9/2011 | Choi et al. | 313/46 |
| 2012/0048511 | A1 * | 3/2012 | Moshtagh | 165/80.2 |
| 2012/0139403 | A1 * | 6/2012 | Johnston et al. | 313/46 |
| 2012/0161627 | A1 * | 6/2012 | Chang et al. | 315/35 |
| 2012/0170262 | A1 * | 7/2012 | Hoetzl et al. | 362/227 |
| 2012/0187818 | A1 * | 7/2012 | Chuang | 313/46 |
| 2012/0195043 | A1 * | 8/2012 | Watanabe et al. | 362/249.02 |
| 2012/0250334 | A1 * | 10/2012 | Huang et al. | 362/373 |
| 2012/0275170 | A1 * | 11/2012 | Li et al. | 362/373 |
| 2012/0293057 | A1 * | 11/2012 | Yamamoto et al. | 313/45 |
| 2012/0314422 | A1 * | 12/2012 | Dong et al. | 362/311.02 |
| 2013/0135858 | A1 * | 5/2013 | Wu et al. | 362/235 |

(Continued)

*Primary Examiner* — Jong-Suk (James) Lee
*Assistant Examiner* — Eric Eide
(74) *Attorney, Agent, or Firm* — Kirton McConkie; Evan R. Witt

(57) ABSTRACT

A heat dissipation module and a modular lighting device with the heat dissipation module are provided. The modular lighting device includes a transparent lamp cover and a lamp body. The transparent lamp cover and the lamp body are combined together easily. The heat dissipation module is disposed within a smooth cup-shaped receiving chamber. A circuit board is accommodated within the receiving chamber. An electronic component on the circuit board is contacted with the heat dissipation module. The arrangement of the heat dissipation module can increase the heat dissipating efficiency of the modular lighting device. In comparison with the conventional fin-type lamp cup, the fabricating cost of the lamp cup of the modular lighting device of the present invention is reduced.

20 Claims, 6 Drawing Sheets

(56) References Cited

U.S. PATENT DOCUMENTS

| | | | | |
|---|---|---|---|---|
| 2013/0148364 | A1* | 6/2013 | Osawa | 362/373 |
| 2013/0301268 | A1* | 11/2013 | Johnston et al. | 362/249.02 |
| 2013/0335978 | A1* | 12/2013 | Huang | 362/311.02 |
| 2013/0343055 | A1* | 12/2013 | Eckert et al. | 362/249.01 |
| 2014/0001956 | A1* | 1/2014 | Ter Weeme et al. | 315/113 |
| 2014/0036497 | A1* | 2/2014 | Hussell et al. | 362/235 |
| 2014/0078723 | A1* | 3/2014 | Chen et al. | 362/184 |
| 2014/0092602 | A1* | 4/2014 | Chen | 362/294 |
| 2014/0092603 | A1* | 4/2014 | Chen | 362/294 |
| 2014/0119034 | A1* | 5/2014 | Chen et al. | 362/373 |
| 2014/0126220 | A1* | 5/2014 | Chen et al. | 362/311.02 |
| 2014/0126221 | A1* | 5/2014 | Chen et al. | 362/311.02 |
| 2014/0140067 | A1* | 5/2014 | Chen | 362/294 |
| 2014/0301080 | A1* | 10/2014 | Lim et al. | 362/249.01 |
| 2014/0355241 | A1* | 12/2014 | Takenaka et al. | 362/84 |

* cited by examiner

HEAT DISSIPATION MODULE AND MODULAR LIGHTING DEVICE WITH HEAT DISSIPATION MODULE

FIELD OF THE INVENTION

The present invention relates to a lighting device, and more particularly to a modular lighting device using engaging structures for coupling associated components.

BACKGROUND OF THE INVENTION

Generally, a lamp bulb comprises a lamp cover, a lamp body, a lamp holder, and an illumination module. If the lamp bulb is a multifunctional lamp bulb, more components should be installed within the lamp bulb. Conventionally, the components of the lamp bulb are combined together by using screws to fasten the components or using glue to bond the components together. However, since the components of the lamp bulb are all small-sized components, it is difficult to tighten the screws or dispense the glue. In other words, the assembling process of the conventional lamp bulb is time-consuming, and the throughput of the conventional lamp bulb is low.

On the other hand, if the lamp bulb has been used for a time period, a great deal of heat is generated by the lamp bulb. Due to the inherent properties of the glue, the glue is readily subject to deformation or molten by the high temperature. If the glue is molten, the components bonded by the glue may be shifted or damaged. Under this circumstance, the reliability of the lamp bulb is reduced.

For solving the above drawbacks, a LED lamp disclosed in Taiwanese Patent Publication No. 201126094 comprises a lamp holder and a lamp body with a LED module. The lamp holder and the lamp body are coupled with each other through clasping means. In addition, a lamp disclosed in Taiwanese Patent Publication No. 201142188 comprises a lamp body and a lamp cover which is matching the lamp body. Corresponding to a latching element of the lamp cover, a fixing groove is located near an end of the lamp body. Due to the engagement between the latching element and the fixing groove, the lamp cover is fixed on the lamp body.

Moreover, the conventional LED lamp bulb uses fins to remove heat. Since the fins are costly, the uses of the fins may increase the fabricating cost of the LED lamp bulb. In addition, the uses of the fins need a special design or increase the overall weight of the lamp bulb.

Therefore, there is a need of providing a lamp bulb with enhanced heat dissipating efficiency and reduced fabricating cost.

SUMMARY OF THE INVENTION

For obviating the drawbacks encountered from the prior art technology, the present invention provides a heat dissipation module and a modular lighting device with the heat dissipation module. In accordance with the present invention, the heat dissipation module can be easily installed in a lamp body. Due to the engagement between the matching engaging structures of the lamp body and a transparent lamp cover, the lamp body and the transparent lamp cover may be directly coupled with each other by the assembly worker. In other words, the process of assembling the heat dissipation module and the modular lighting device is simple and efficient, and thus the product reliability is enhanced.

For obviating the drawbacks encountered from the prior art technology, the present invention provides a heat dissipation module and a modular lighting device with the heat dissipation module. In accordance with the present invention, the fins used in the conventional lamp bulb are replaced by the smooth surface of the lamp cup. Similarly, the lamp cup and the transparent lamp cover may be easily assembled by the assembly worker. Consequently, the assembling efficiency is increased, and the fabricating cost of the product is reduced.

In accordance with an aspect of the present invention, there is provided a heat dissipation module for a modular lighting device. The modular lighting device includes a lamp body, a circuit board, a LED illumination module and a transparent lamp cover. The lamp body includes a receiving chamber and a middle sleeve within the receiving chamber. The circuit board includes at least one electronic component and a part of the circuit board is accommodated within the middle sleeve. The LED illumination module is disposed on the lamp body. The transparent lamp cover covers the LED illumination module and is coupled with the lamp body. The heat dissipation module includes at least one heat dissipation block and a ring-shaped heat dissipation structure. The at least one heat dissipation block is contacted with the electronic component. The heat dissipation block is penetrated through a sidewall of the middle sleeve, so that at least one part of the heat dissipation block is exposed outside the sidewall of the middle sleeve. The ring-shaped heat dissipation structure is contacted with the exposed part of the heat dissipation block, sheathed around the sidewall of the middle sleeve and disposed within the receiving chamber.

In accordance with another aspect of the present invention, there is provided a heat dissipation module for a modular lighting device. The modular lighting device includes a lamp body, a circuit board, a LED illumination module and a transparent lamp cover. The lamp body includes a receiving chamber and a middle sleeve within the receiving chamber. The circuit board includes at least one electronic component and a part of the circuit board is accommodated within the middle sleeve. The LED illumination module is disposed on the lamp body. The transparent lamp cover covers the LED illumination module and is coupled with the lamp body. The heat dissipation module includes at least one heat dissipation block and a ring-shaped heat dissipation structure. The at least one heat dissipation block is contacted with the electronic component, wherein the heat dissipation block is penetrated through a sidewall of the middle sleeve, so that at least one part of the heat dissipation block is exposed outside the sidewall of the middle sleeve. The ring-shaped heat dissipation structure is contacted with the exposed part of the heat dissipation block, sheathed around the sidewall of the middle sleeve and locked on the sidewall of the middle sleeve.

In accordance with another aspect of the present invention, there is provided a heat dissipation module for a modular lighting device. The modular lighting device includes a lamp body, a circuit board, a LED illumination module and a transparent lamp cover. The lamp body includes a receiving chamber and a middle sleeve within the receiving chamber. A part of the circuit board is accommodated within the middle sleeve. The LED illumination module is disposed on the lamp body. The transparent lamp cover covers the LED illumination module and is coupled with the lamp body. The heat dissipation module includes plural heat dissipation blocks, a ring-shaped heat dissipation structure, and at least one thermal conductive adhesive. The plural heat dissipation blocks are in thermal contact with the circuit board. The plural dissipation blocks are penetrated through plural perforations of a sidewall of the middle sleeve, so that at least one part of the heat dissipation blocks is exposed to the plural perforations of the middle sleeve. The plural heat dissipation blocks are aligned with the plural perforations, respectively. The ring-shaped heat dissipation structure is contacted with the exposed part of the heat dissipation blocks, sheathed around the sidewall of the middle sleeve and disposed within the receiving chamber. The at least one thermal conductive adhesive is arranged between the plural heat dissipation blocks and the ring-shaped heat dissipation structure for fixing the plural heat dissipation blocks and the ring-shaped heat dissipation structure.

In accordance with another aspect of the present invention, there is provided a modular lighting device with one of the above heat dissipation modules. The modular lighting device further includes a lamp cup and a sensing and driving module. The lamp cup is included in the lamp body. The lamp cup includes an installation plane with a hollow part. The installation plane includes a first engaging structure. The sensing and driving module includes the circuit board and a sensing device. The sensing device is penetrated through the hollow part of the installation plane and protruded over the installation plane. The LED illumination module is supported on the installation plane of the lamp body. In addition, the transparent lamp cover is coupled to the lamp body through the first engaging structure.

In an embodiment, the lamp cup includes an outer surface and an inner surface opposed to the outer surface, and both of the outer surface and the inner surface are smooth surfaces. Alternatively, the sensing and driving module further includes a light-sheltering cover for enclosing the sensing device, and the sensing device includes a passive infrared human body sensor. Alternatively, the LED illumination module is supported on the installation plane and coupled to the middle sleeve. Alternatively, wherein the modular lighting device further includes a lamp holder module, the lamp holder module and the LED illumination module are respectively located at two ends of the lamp body, the lamp holder module includes a second engaging structure, and the lamp holder module is coupled to the lamp body through the second engaging structure. Alternatively, the modular lighting device further includes a lamp holder module and plural foreign matter preventing structures, the lamp holder module and the LED illumination module are respectively located at two ends of the lamp body, and the plural foreign matter preventing structures are arranged between the transparent lamp cover and the lamp body and between the lamp body and the lamp holder module.

In an embodiment, the lamp cup includes an outer surface and an inner surface opposed to the outer surface, and both of the outer surface and the inner surface are smooth surfaces. Moreover, the sensing device includes a passive infrared human body sensor or a microwave sensor. Moreover, the LED illumination module is supported on the installation plane of the lamp body and coupled to the middle sleeve. Moreover, the modular lighting device further includes a lamp holder module, the lamp holder module and the LED illumination module are respectively located at two ends of the lamp body, the lamp holder module includes a second engaging structure, and the lamp holder module is coupled to the lamp body through the second engaging structure.

In an embodiment, the lamp cup includes an outer surface and an inner surface opposed to the outer surface, both of the outer surface and the inner surface are smooth surfaces, and the outer surface, the inner surface, the installation plane and the first engaging structure are integrally formed with each other or detachably coupled to each other. Moreover, the sensing and driving module further includes a light-sheltering cover for enclosing the sensing device, and the sensing device includes a passive infrared human body sensor. Moreover, the transparent lamp cover includes an opening at a top end and a lens, the light-sheltering cover is embedded into the opening, and the light-sheltering cover is capped by the lens. Alternatively, the modular lighting device further includes a lamp holder module, the lamp holder module and the LED illumination module are respectively located at two ends of the lamp body, the lamp holder module includes a second engaging structure, and the lamp holder module is coupled to the lamp body through the second engaging structure.

In an embodiment, the lamp cup includes an outer surface and an inner surface opposed to the outer surface, both of the outer surface and the inner surface are smooth surfaces, and the outer surface, the inner surface, the installation plane and the first engaging structure are integrally formed as a one-piece metal part or detachably coupled to each other. Moreover, the sensing and driving module further includes a light-sheltering cover for enclosing the sensing device, and the sensing device includes a passive infrared human body sensor. Moreover, the transparent lamp cover includes an opening at a top end and a lens, the light-sheltering cover is embedded into the opening, and the light-sheltering cover is capped by the lens. Moreover, the modular lighting device further includes a lamp holder module, the lamp holder module and the LED illumination module are respectively located at two ends of the lamp body, the lamp holder module includes a second engaging structure, and the lamp holder module is coupled to the lamp body through the second engaging structure. Moreover, the modular lighting device further includes plural foreign matter preventing structures, and the plural foreign matter preventing structures are arranged between the transparent lamp cover and the lamp body and between the lamp body and the lamp holder module.

In an embodiment, the lamp cup includes an outer surface and an inner surface opposed to the outer surface, both of the outer surface and the inner surface are smooth surfaces, and the outer surface, the inner surface, the installation plane and the first engaging structure are integrally formed as a one-piece metal part or detachably coupled to each other. Moreover, the sensing and driving module further includes a coupling element for coupling the sensing device with the middle sleeve, and the sensing device includes a microwave sensor. Moreover, the modular lighting device further includes a lamp holder module, the lamp holder module and the LED illumination module are respectively located at two ends of the lamp body, the lamp holder module includes a second engaging structure, and the lamp holder module is coupled to the lamp body through the second engaging structure. Moreover, the modular lighting device further includes plural foreign matter preventing structures, and the plural foreign matter preventing structures are arranged between the transparent lamp cover and the lamp body and between the lamp body and the lamp holder module.

In an embodiment, the lamp cup includes an outer surface and an inner surface opposed to the outer surface, both of the outer surface and the inner surface are smooth surfaces, and the outer surface, the inner surface, the installation plane and the first engaging structure are integrally formed as a one-piece metal part or detachably coupled to each other. Moreover, the sensing and driving module further includes a light-sheltering cover for enclosing the sensing device, and the sensing device includes a passive infrared human body sensor. Moreover, the modular lighting device further includes a lamp holder module, the lamp holder module and the LED illumination module are respectively located at two ends of the lamp body, the lamp holder module includes an inner tube and a conductive outer casing, and the conductive outer casing is sheathed around the inner tube. Moreover, the modular lighting device further includes plural waterproof sealing rings, and the plural waterproof sealing rings are arranged between the transparent lamp cover and the lamp body and between the lamp body and the lamp holder module.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
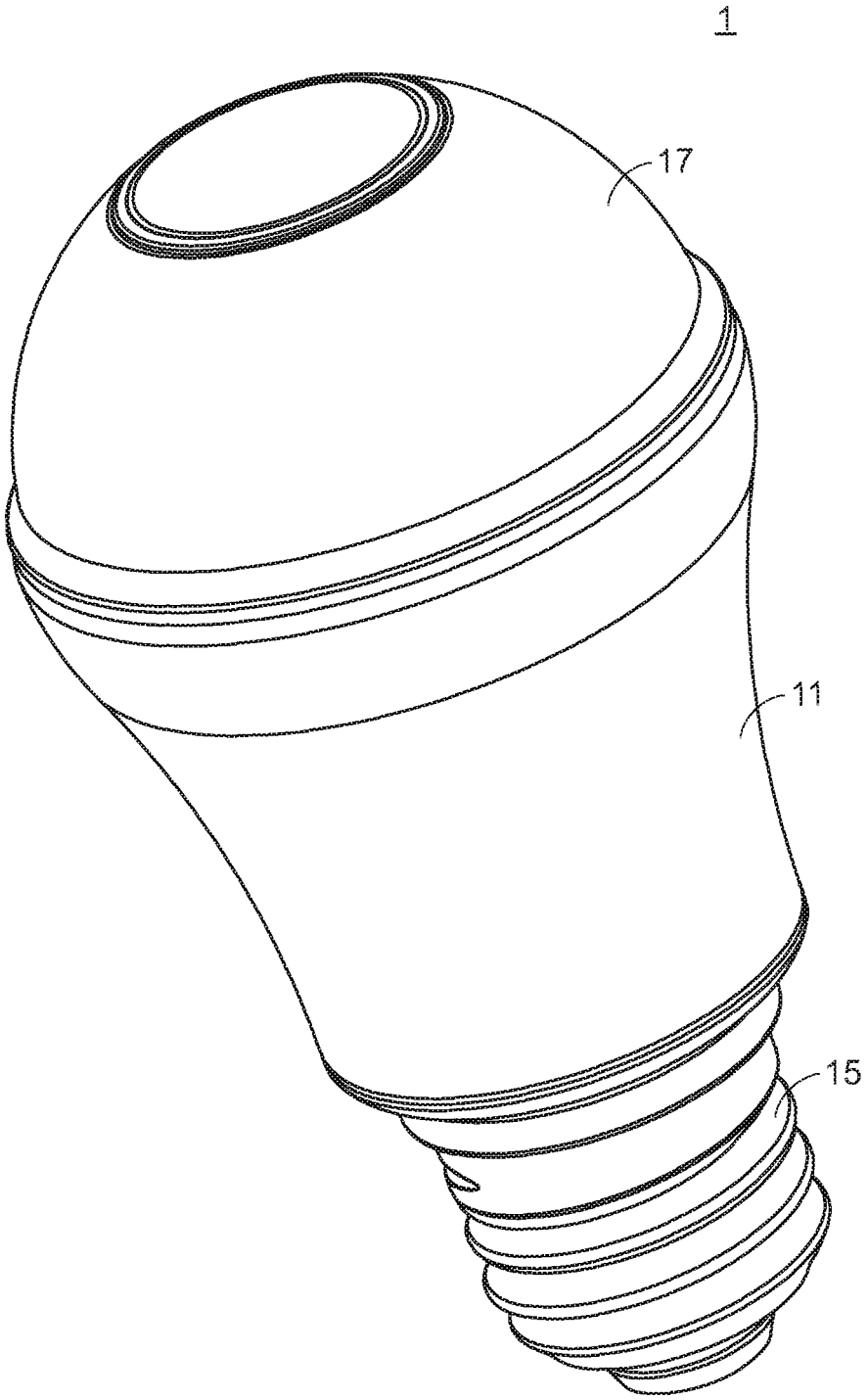
FIG. 1 is a schematic perspective view illustrating the outer appearance of a modular lighting device according to an embodiment of the present invention.
Figure 2:
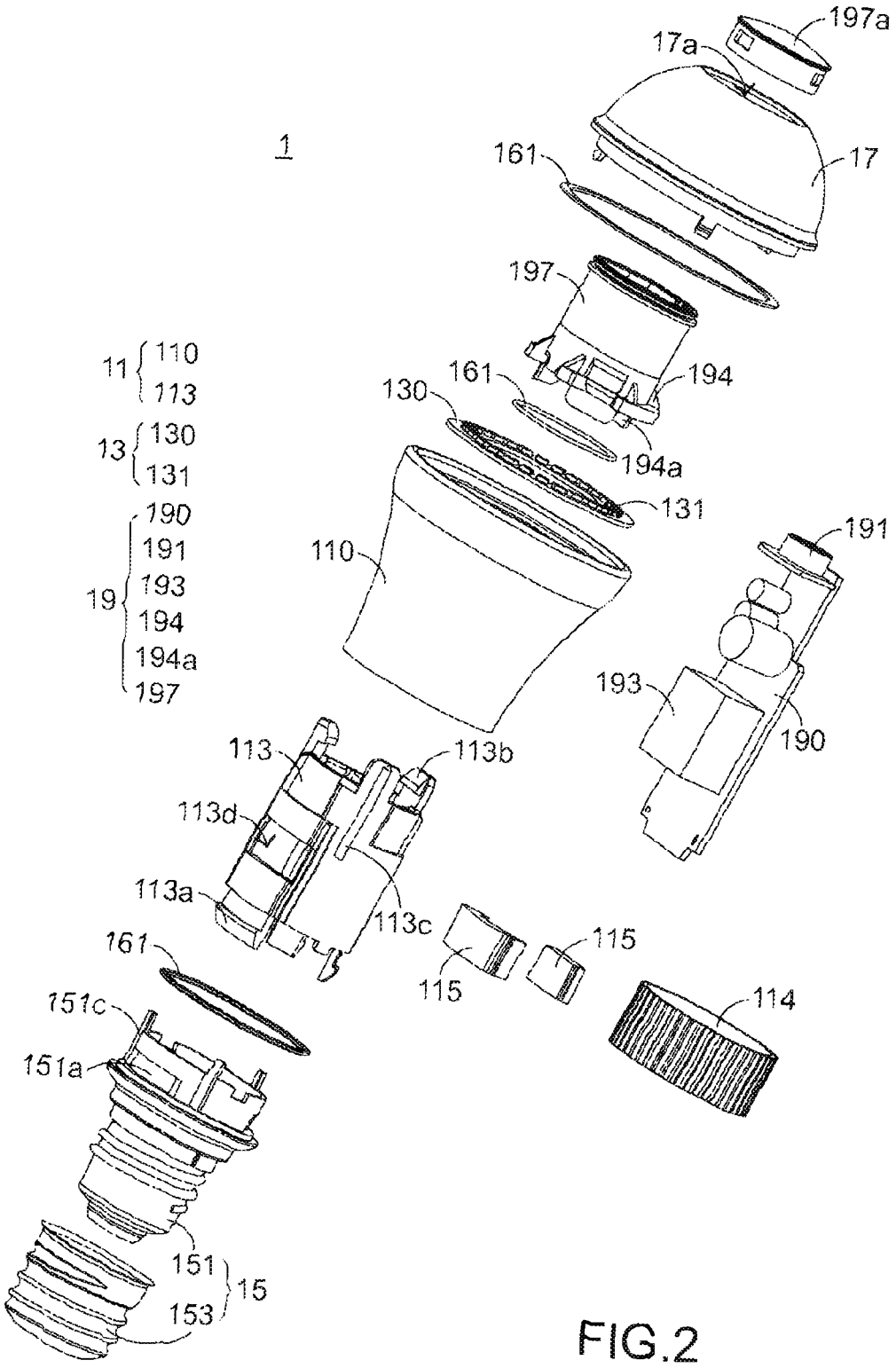
FIG. 2 is a schematic exploded view illustrating the overall structure of the modular lighting device according to the embodiment of the present invention.

FIG. 1 is a schematic perspective view illustrating the outer appearance of a modular lighting device according to an embodiment of the present invention. FIG. 2 is a schematic exploded view illustrating the overall structure of the modular lighting device according to the embodiment of the present invention. As shown in FIGS. 1 and 2, the modular lighting device 1 comprises a lamp body 11, a lamp holder module 15, a LED illumination module 13, a transparent lamp cover 17, and a sensing and driving module 19. The lamp holder module 15 is located at a first end of the lamp body 11. The transparent lamp cover 17 is used for covering the LED illumination module 13. Consequently, the transparent lamp cover 17 and the LED illumination module 13 are located at a second end of the lamp body 11 and opposed to the lamp holder module 15. Moreover, the lamp body 11 comprises a lamp cup 110 and a middle sleeve 113. The LED illumination module 13 comprises plural LED dies 131, which are mounted on a base plate 130. The lamp holder module 15 comprises an insulating inner tube 151 and a conductive outer casing 153. The outer casing 153 is sheathed around the inner tube 151. The sensing and driving module 19 comprises a circuit board 190, a sensing device 191, a driving integrated chip 192 (see FIG. 6), a transformer 193, and a coupling element 194. The sensing device 191, the driving integrated chip 192 and the transformer 193 are disposed on the circuit board 190. Since the driving integrated chip is disposed on another surface of the circuit board 190, the driving integrated chip 192 is not shown in FIG. 2. In addition, the coupling element 194 comprises a first engaging structure 194*a*.

Figure 3:
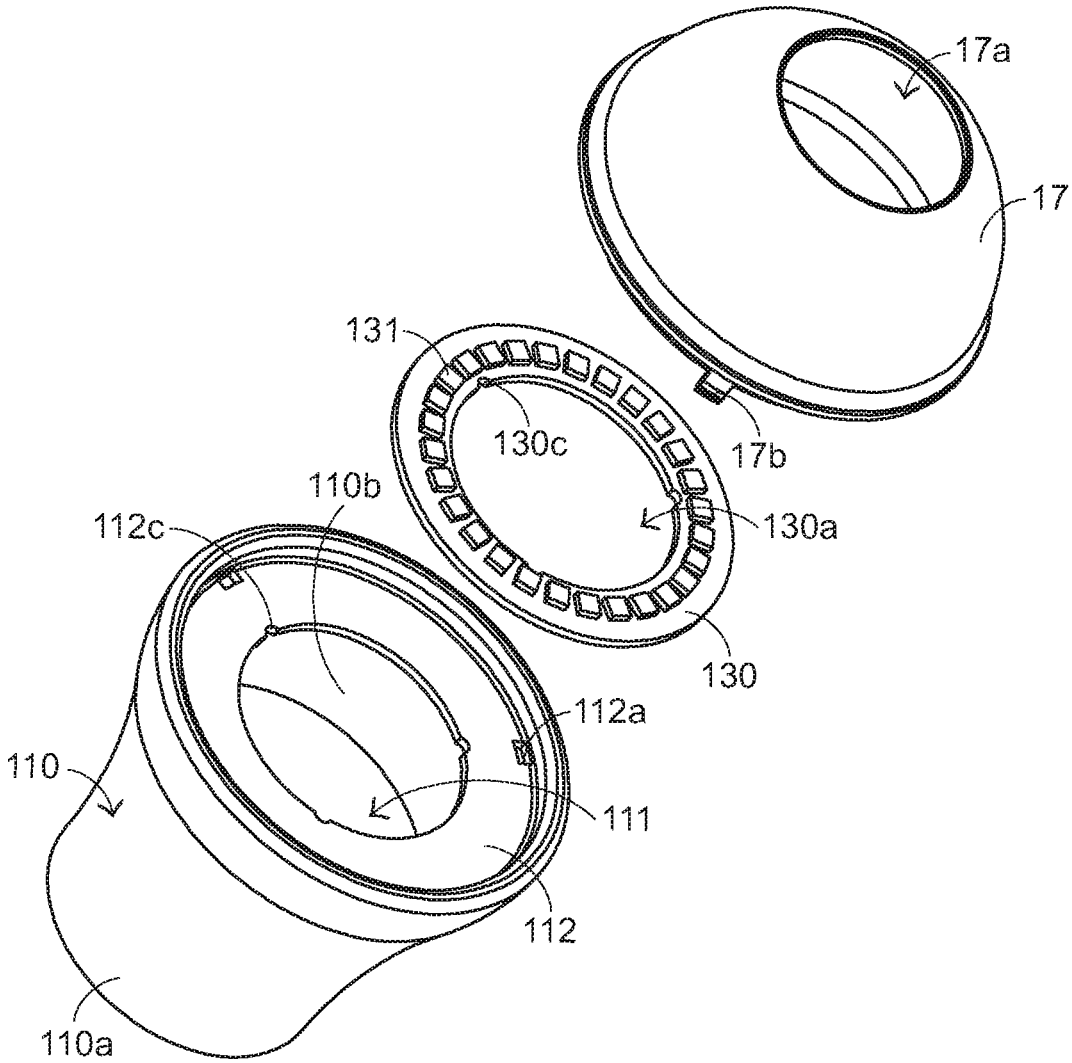
FIG. 3 is a schematic exploded view illustrating some components of the modular lighting device according to the embodiment of the present invention.

FIG. 3 is a schematic exploded view illustrating some components of the modular lighting device according to the embodiment of the present invention. Please refer to FIGS. 2 and 3. The transparent lamp cover 17 comprises an opening 17*a* and at least one first engaging structure 17*b*. The opening 17*a* is located at a top end of the transparent lamp cover 17. The at least one first engaging structure 17*b* is distributed on a periphery of a bottom end of the transparent lamp cover 17, wherein the bottom end is opposed to the top end. The base plate 130 of the LED illumination module 13 comprises a hollow part 130*a* for partially accommodating the middle sleeve 113. Moreover, the base plate 130 comprises at least one first engaging structure 130*c*. The at least one first engaging structure 130*c* is distributed on a periphery of the hollow part 130*a* to be engaged with at least one third engaging structure 113*c* of the middle sleeve 113. Moreover, the base plate 130 is an annular metal plate or circuit board. Consequently, the LED dies 131 are electrically connected with an external circuit (not shown) through the base plate 130.

The lamp cup 110 comprises an outer surface 110*a* and an inner surface 110*b*. The outer surface 110*a* and the inner surface 110*b* are both smooth surfaces. Moreover, the outer surface 110*a* and the inner surface 110*b* are opposed to each other. Especially, a receiving chamber 111 is defined by the inner surface 110*b* of the lamp cup 110 in order to accommodate the middle sleeve 113. Moreover, the lamp cup 110 further comprises an installation plane 112 with a hollow part. The installation plane 112 is located at an end of the lamp cup 110 that faces the transparent lamp cover 17. In addition, at least one first engaging structure 112*a* is distributed on an outer periphery of the installation plane 112, and at least one second engaging structure 112*c* is distributed on a periphery of the hollow part of the installation plane 112. Moreover, the outer surface 110*a* is slightly protruded over the installation plane 112. Consequently, a lateral wall is formed around the installation plane 112 and the at least one first engaging structure 112*a*.

In this embodiment, the first engaging structure 112*a* of the installation plane 112 is engaged with the first engaging structure 17*b* of the transparent lamp cover 17. Due to the engagement between the first engaging structure 112*a* and the first engaging structure 17*b*, the transparent lamp cover 17 is coupled to the lamp cup 110 of the lamp body 11. The profiles of the first engaging structure 112*a* and the first engaging structure 17*b* are not restricted as long as they have matching structures. For example, the first engaging structure 112*a* and the first engaging structure 17*b* may be an engaging recess and a hook, a slot and a hook, or an engaging recess and a fastener, respectively. Moreover, if plural first engaging structures are distributed on the installation plane 112 and the periphery of the transparent lamp cover 17, these first engaging structures may be identical or different.

Moreover, the installation plane 112 is used for supporting the LED illumination module 13. The second engaging structure 112*c* of the installation plane 112 and the first engaging structure 130*c* of the base plate 130 are aligned with each other. The second engaging structure 112*c* of the installation plane 112 is also engaged with the third engaging structure 113*c* of the middle sleeve 113. Moreover, the outer surface 110*a*, the inner surface 110*b*, the installation plane 112, the first engaging structure 112*a* and the second engaging structure 112*c* of the lamp cup 110 may be integrally formed as a one-piece metal part or detachably coupled to each other.

From the above discussions, since the outer surface and the inner surface of the lamp cup 110 are smooth surfaces, the lamp cup 110 is more cost-effective when compared with the conventional fin-type lamp cup. Moreover, since the installation plane 112 has the engaging structure, after the LED illumination module 15 is placed on the installation plane 112, the lamp cup 110 may be directly coupled with the transparent lamp cover 17 through the engagement between the engaging structure of the installation plane 112 and the corresponding engaging structure of the transparent lamp cover 17. In other words, the assembling process is simplified. Optionally, a foreign matter preventing structure 161 is located at the contact region between the lamp cup 110 and the transparent lamp cover 17, so that the lamp cup 110 and the transparent lamp cover 17 are combined together more tightly. Moreover, for achieving the lightweight and heat-dissipating purposes, the lamp cup 110 is preferably made of a metallic material or an alloy material (e.g. aluminum or aluminum alloy).

Moreover, due to the engagement between the first engaging structure 130*c* of the base plate 130 and the third engaging structure 113*c* of the middle sleeve 113, the base plate 130 of the LED illumination module 13 can be directly coupled to the middle sleeve 113. In comparison with the prior art technology of fixing the base plate 130 on the installation plane 112 through screwing means, the component complexity of the modular lighting device 1 of the present invention can be reduced.

Figure 4:
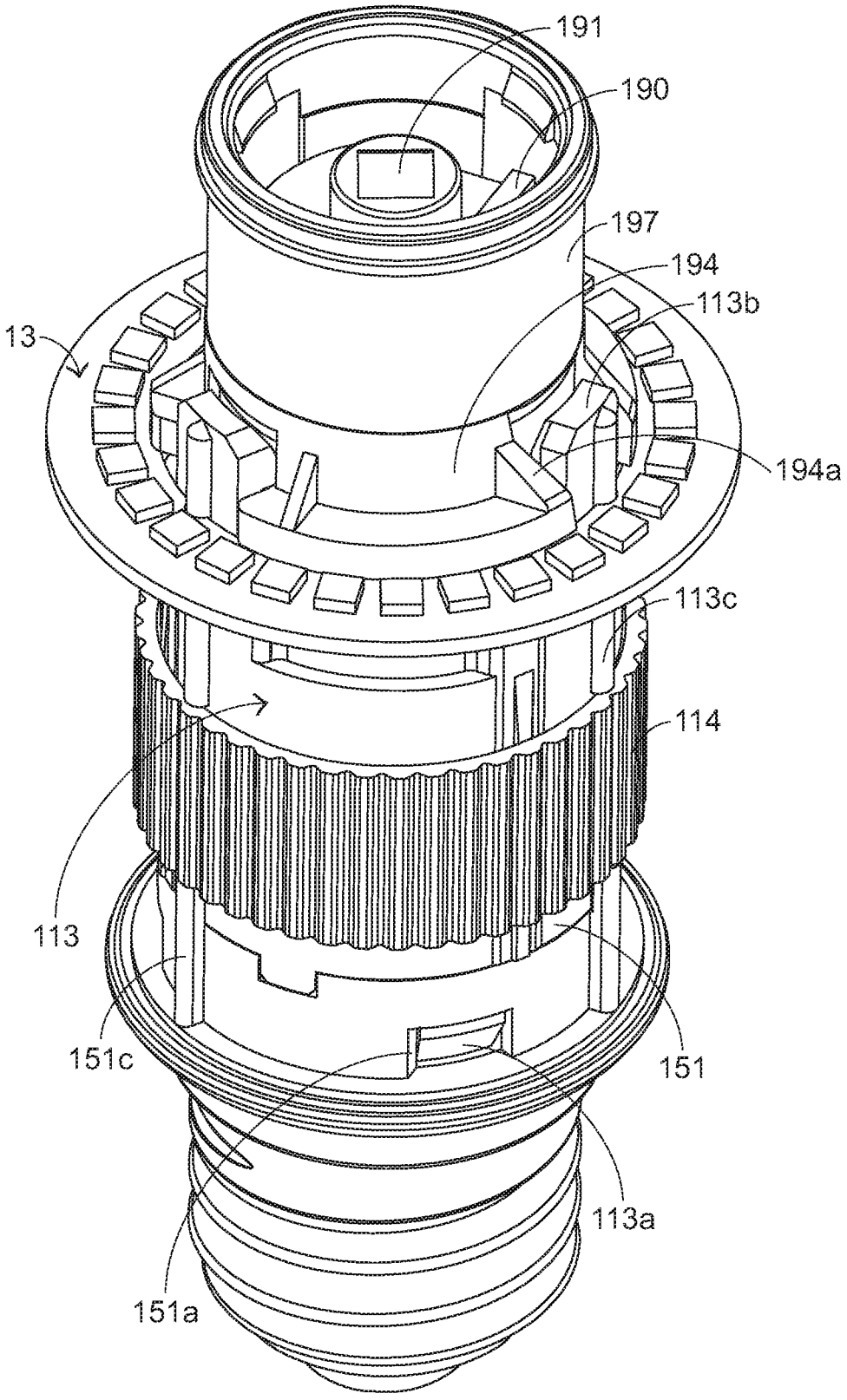
FIG. 4 is a schematic assembled view illustrating some components of the modular lighting device according to the embodiment of the present invention.

FIG. 4 is a schematic assembled view illustrating some components of the modular lighting device according to the embodiment of the present invention. Please refer to FIGS. 2 and 4. The middle sleeve 113 comprises at least one first engaging structure 113*a*, at least one second engaging structure 113*b*, and the at least one third engaging structure 113*c*. The first engaging structure 113*a* and the second engaging structure 113*b* are located at two opposed ends of the middle sleeve 113, respectively. The third engaging structure 113*c* is located at an outer surface of the second engaging structure 113*b*. The first engaging structure 113*a* of the middle sleeve 113 matches a first engaging structure 151*a* of the inner tube 151 of the lamp holder module 15. For example, the first engaging structure 113*a* of the middle sleeve 113 is an engaging bulge, and the first engaging structure 151*a* of the lamp holder module 15 is an engaging groove. When the lamp holder module 15 or the lamp body 11 is simply pushed by the assembly worker, the first engaging structure 151*a* of the inner tube 151 of the lamp holder module 15 can be engaged with the first engaging structure 113*a* of the middle sleeve 113 of the lamp body 11. Consequently, the middle sleeve 113 and the inner tube 151 are combined together. It is noted that the way of combining middle sleeve 113 with the inner tube 151 is presented herein for purpose of illustration and description only.

Moreover, at least one part of the circuit board 190 of the sensing and driving module 19 is penetrated through the middle sleeve 113, and protruded out of the middle sleeve 113 and extended toward the transparent lamp cover 17. Due to this arrangement, the assembling process will not be hindered by the volume of the circuit board 190. Under this circumstance, the space utilization is largely enhanced, and the flexibility of installing the components is increased. Moreover, the first engaging structure 194*a* of the coupling element 194 is engaged with the second engaging structure 113*b* of the middle sleeve 113. In this embodiment, the second engaging structure 113*b* is an engaging leg, and the first engaging structure 194*a* is an engaging slot. In response to a pushing action of the assembly worker, the engaging leg and the engaging slot can be engaged with each other more easily.

As mentioned above, the third engaging structure 113*c* of the middle sleeve 113 may be engaged with the LED illumination module 13. Furthermore, the third engaging structure 113*c* of the middle sleeve 113 may be engaged with the second engaging structure 151*c* of the inner tube 151 of the lamp holder module 15 in order to confine or fix a ring-shaped heat dissipation structure 114, which will be described later.

In this embodiment, the sensing device 191 is a passive infrared human body sensor (PIR) or a microwave sensor. In case that the sensing device 191 is the passive infrared human body sensor (PIR), the sensing and driving module 19 further comprises a light-sheltering cover 197 for enclosing the sensing device 191. Due to the light-sheltering cover 197, the light beam or heat generated by the LED illumination module 13 will not interfere with the sensing device 191. Moreover, a top end of the transparent lamp cover 17 has an opening 17*a* corresponding to the light-sheltering cover 197. The light-sheltering cover 197 is embedded into the opening 17*a* in order to achieve a better detecting field. Moreover, the top end of the light-sheltering cover 197 is capped by a lens 197*a*. The light-sheltering cover 197 and the coupling element 194 may be detachably coupled with each other. Alternatively, in this embodiment, the light-sheltering cover 197 and the coupling element 194 are integrally formed with each other.

Figure 5:
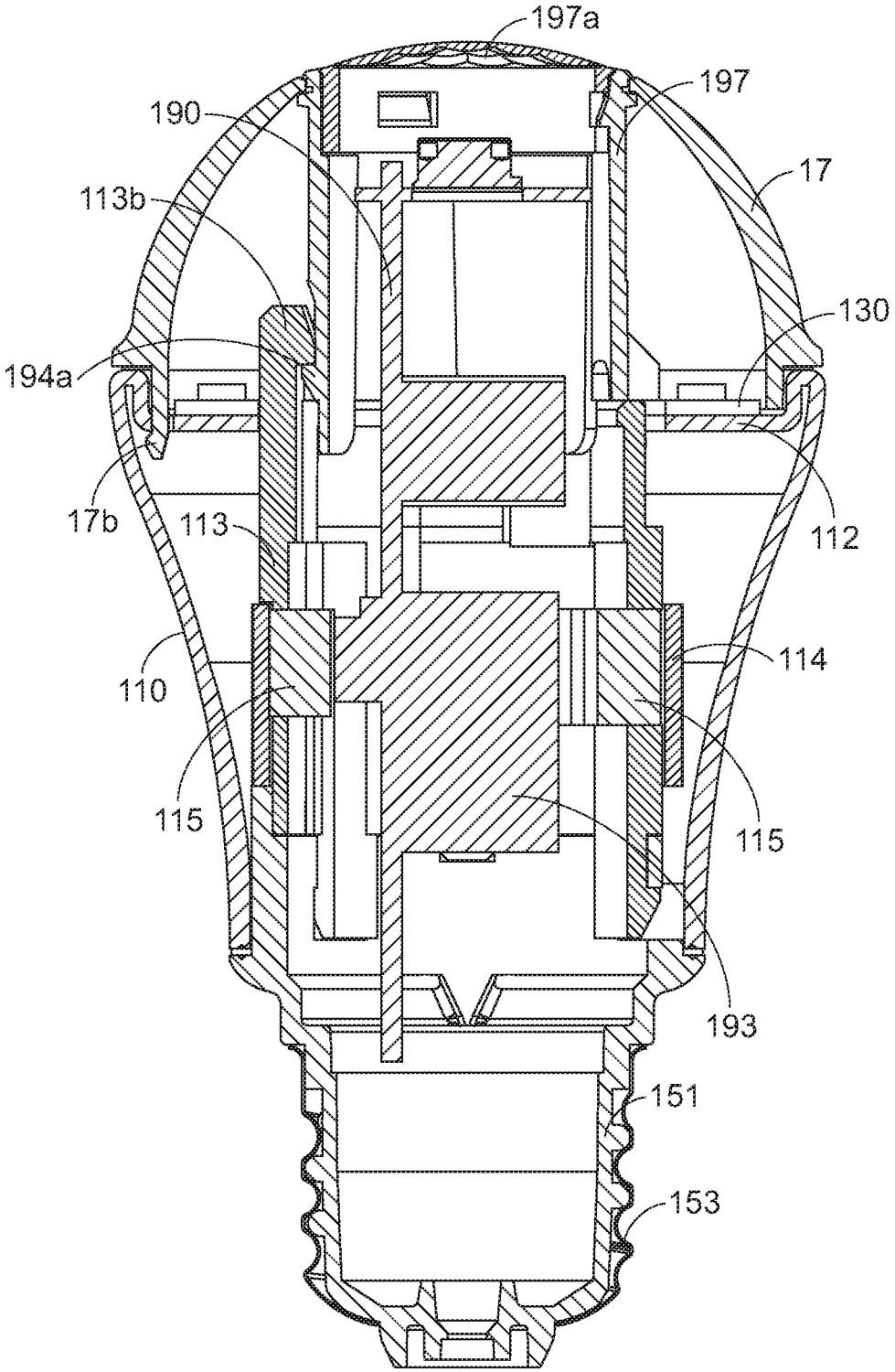
FIG. 5 is a schematic cross-sectional view illustrating some components of the modular lighting device according to the embodiment of the present invention.
Figure 6:
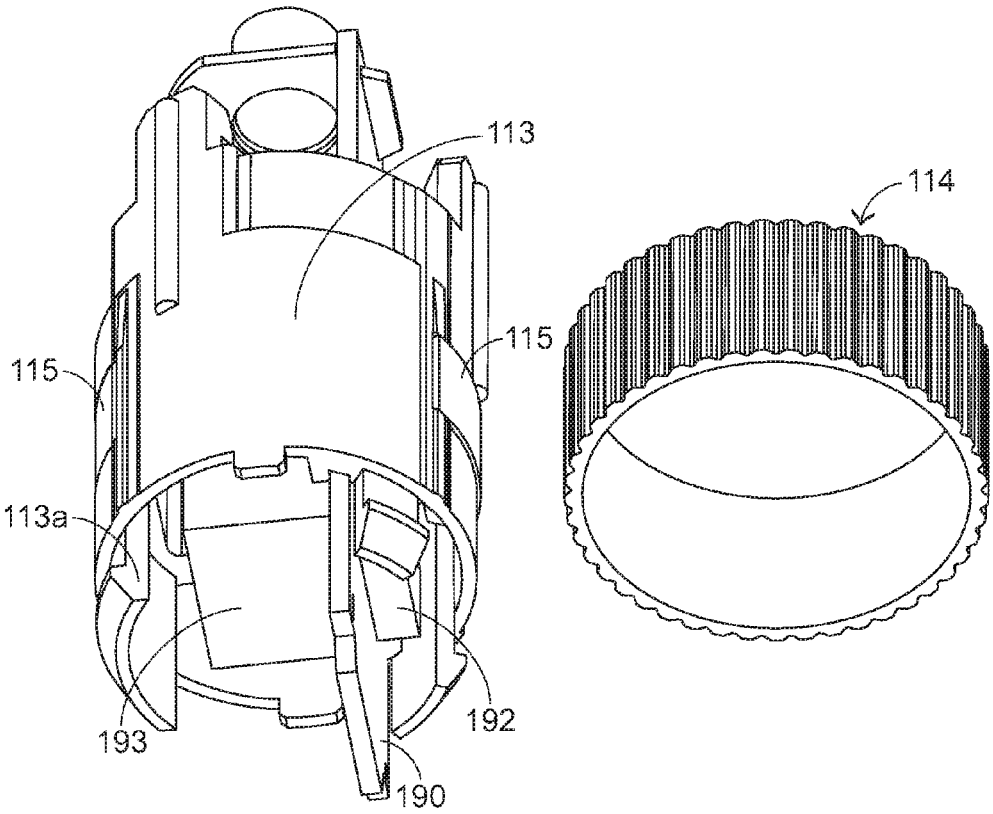
FIG. 6 is a schematic partial exploded view illustrating some components of the modular lighting device according to the embodiment of the present invention.
Figure 7:
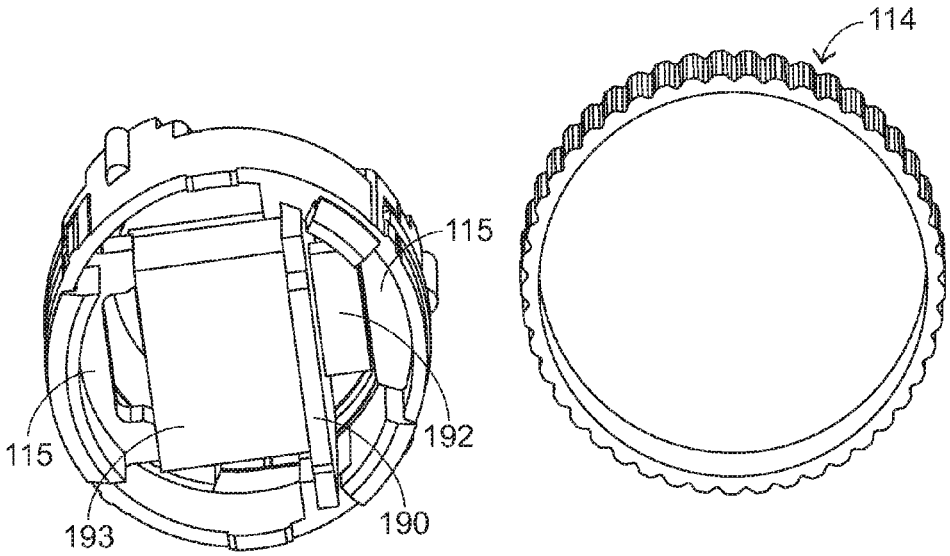
FIG. 7 is a schematic partial bottom view illustrating some components of the modular lighting device according to the embodiment of the present invention.

Hereinafter, a heat dissipation module for the modular lighting device 1 of the present invention will be illustrated with reference to FIGS. 5, 6 and 7. FIG. 5 is a schematic cross-sectional view illustrating some components of the modular lighting device according to the embodiment of the present invention. FIG. 6 is a schematic partial exploded view illustrating some components of the modular lighting device according to the embodiment of the present invention. FIG. 7 is a schematic partial bottom view illustrating some components of the modular lighting device according to the embodiment of the present invention. Please refer to FIG. 2, FIG. 5, FIG. 6 and FIG. 7. The outer surface 110*a* and the inner surface 110*b* of the lamp cup 110 are both smooth surfaces and made of a metallic material. Consequently, the outer surface 110*a* and the inner surface 110*b* of the lamp cup 110 can facilitate removing heat through convection. Moreover, the lamp body 11 further comprises a heat dissipation block 115. At least one perforation 113*d* is formed in a sidewall of the middle sleeve 113. The heat dissipation block 115 is penetrated through the perforation 113*d*. The top end and the bottom end of the heat dissipation block 115 are contacted with the periphery of the middle sleeve 113. Moreover, an inner surface of the heat dissipation block 115 is directly or indirectly contacted with the electronic component on the circuit board 190. For example, the heat dissipation block 115 is directly or indirectly contacted with the driving integrated chip 192 and/or the transformer 193 in order to facilitate removing the heat from the driving integrated chip 192 and/or the transformer 193. Optionally, the lamp body 11 may further comprise a silicone pad (not shown). The heat dissipation block 115 may be indirectly contacted with the heat generation component through the silicon pad. For example, the silicon pad may be clamped between the heat dissipation block 115 and the driving integrated chip 192 and/or the transformer 193. Due to the flexibility and high thermal conductivity of the silicon pad, the silicon pad may be attached on the driving integrated chip 192 and/or the transformer 193 and/or other electronic component that has non-uniform height distribution.

In addition to the heat dissipation block 115, the lamp body 11 further comprises a ring-shaped heat dissipation structure 114. The ring-shaped heat dissipation structure 114 is sheathed around the sidewall of the middle sleeve 113. The ring-shaped heat dissipation structure 114 is in direct contact with the part of the heat dissipation block 115 that is exposed outside the perforation 113*d*. Alternatively, the ring-shaped heat dissipation structure 114 is sheathed around the middle sleeve 113, and locked on the sidewall of the middle sleeve 113. Alternatively, the ring-shaped heat dissipation structure 114 is disposed within the receiving chamber 111. After the heat dissipation block 115 is in direct contact with at least one of the driving integrated chip 192 and the transformer 193, the heat dissipation block 115 is further in direct contact with the ring-shaped heat dissipation structure 114. Consequently, the heat can be quickly transferred to the outer surface of the middle sleeve 113. Moreover, the ring-shaped heat dissipation structure 114 may be directly attached on the heat dissipation block 115 through a thermal conductive adhesive (not shown). Alternatively, the third engaging structure 113*c* at the outer surface of the middle sleeve 113 and the second engaging structure 151*c* of the inner tube 151 may cooperate with each other to fix the ring-shaped heat dissipation structure 114.

From the above discussions, the conventional lamp cup 110 uses fins to remove heat. Since the fins are costly, the uses of the fins may increase the material cost and the fabricating cost of the modular lighting device 1. Moreover, since the driving integrated chip 192 and the transformer 193 are continuously improved, the generation of the waste heat is reduced. In other words, the fin-type lamp cup needs to be correspondingly improved. In accordance with the present invention, the heat dissipation module comprises the ring-shaped heat dissipation structure 114. Consequently, after the heat from the circuit board within the lamp cup 11 is transferred to the outer surface of the lamp cup 11 through conduction, the heat is dissipated away from the receiving chamber 111 of the lamp cup through convection or radiation. Since the ring-shaped heat dissipation structure is cheap and has the function of removing heat, the use of the ring-shaped heat dissipation structure 114 can reduce the fabricating cost of the modular lighting device 1 while achieving a satisfactory heat dissipating efficiency.

Please refer to FIG. 2 again. The modular lighting device further comprises plural foreign matter preventing structures 161 such as waterproof sealing rings. The plural foreign matter preventing structures 161 may be located at the contact region between any two structures. For example, one foreign matter preventing structure 161 is arranged between the lens 197*a* and the light-sheltering cover 197, between the light-sheltering cover 197 and the transparent lamp cover 17, between the coupling element 194 and the LED illumination module 13 or between the middle sleeve 113 and the inner tube 151, but is not limited thereto.

From the above descriptions, the present invention provides a heat dissipation module and a modular lighting device with the heat dissipation module. Due to the engagement between the matching engaging structures of the lamp body and the transparent lamp cover, the lamp body and the transparent lamp cover can be directly coupled with each other by the assembly worker. Since it is not necessary to couple components by screwing means or glue, the assembling process is time-saving and the product reliability is enhanced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A modular lighting device comprising a heat dissipation module, a lamp body, a circuit board, a LED illumination module and a transparent lamp cover, the lamp body comprising a receiving chamber and a middle sleeve within the receiving chamber, the circuit board comprising at least one electronic component and a part of the circuit board being accommodated within the middle sleeve, the LED illumination module being disposed on the lamp body, the transparent lamp cover covering the LED illumination module and being coupled with the lamp body, the heat dissipation module comprising:

at least one heat dissipation block contacted with the electronic component, wherein the heat dissipation block penetrates through a sidewall of the middle sleeve, so that at least one part of the heat dissipation block is exposed outside the sidewall of the middle sleeve; and a ring-shaped heat dissipation structure contacted with the exposed part of the heat dissipation block, sheathed around the sidewall of the middle sleeve and disposed within the receiving chamber.

2. A modular lighting device comprising a heat dissipation module, a lamp body, a circuit board, a LED illumination module and a transparent lamp cover, the lamp body comprising a receiving chamber and a middle sleeve within the receiving chamber, the circuit board comprising at least one electronic component and a part of the circuit board being accommodated within the middle sleeve, the LED illumination module being disposed on the lamp body, the transparent lamp cover covering the LED illumination module and being coupled with the lamp body, the heat dissipation module comprising:

at least one heat dissipation block contacted with the electronic component, wherein the heat dissipation block penetrates through a sidewall of the middle sleeve, so that at least one part of the heat dissipation block is exposed outside the sidewall of the middle sleeve; and a ring-shaped heat dissipation structure contacted with the exposed part of the heat dissipation block, sheathed around the sidewall of the middle sleeve and locked on the sidewall of the middle sleeve.

3. A modular lighting device comprising a heat dissipation module, a lamp body, a circuit board, a LED illumination module and a transparent lamp cover, the lamp body comprising a receiving chamber and a middle sleeve within the receiving chamber, a part of the circuit board being accommodated within the middle sleeve, the LED illumination module being disposed on the lamp body, the transparent lamp cover covering the LED illumination module and being coupled with the lamp body, the heat dissipation module comprising:

a plurality of heat dissipation blocks in thermal contact with the circuit board, wherein the plurality of heat dissipation blocks are penetrated through a plurality of perforations of a sidewall of the middle sleeve, so that at least one part of the heat dissipation blocks is exposed to the plurality of perforations of the middle sleeve, wherein the plurality of heat dissipation blocks are aligned with the plurality of perforations, respectively;

a ring-shaped heat dissipation structure contacted with the exposed part of the heat dissipation blocks, sheathed around the sidewall of the middle sleeve and disposed within the receiving chamber; and at least one thermal conductive adhesive arranged between the plurality of heat dissipation blocks and the ring-shaped heat dissipation structure for fixing the plurality of heat dissipation blocks and the ring-shaped heat dissipation structure.

4. A modular lighting device with the heat dissipation module according to claim 1, the modular lighting device comprising:

a lamp cup included in the lamp body, wherein the lamp cup comprises an installation plane with a hollow part, and the installation plane comprises a first engaging structure; and a sensing and driving module comprising the circuit board and a sensing device, wherein the sensing device is penetrated through the hollow part of the installation plane and protruded over the installation plane, wherein the LED illumination module is supported on the installation plane of the lamp body, and the transparent lamp cover is coupled to the lamp body through the first engaging structure.

5. The modular lighting device according to claim 4, wherein the lamp cup comprises an outer surface and an inner surface opposed to the outer surface, and both of the outer surface and the inner surface are smooth surfaces; or wherein the sensing and driving module further comprises a light-sheltering cover for enclosing the sensing device, and the sensing device comprises a passive infrared human body sensor; or wherein the LED illumination module is supported on the installation plane and coupled to the middle sleeve; or wherein the modular lighting device further comprises a lamp holder module, the lamp holder module and the LED illumination module are respectively located at two ends of the lamp body, the lamp holder module comprises a second engaging structure, and the lamp holder module is coupled to the lamp body through the second engaging structure; or wherein the modular lighting device further comprises a lamp holder module and a plurality of foreign matter preventing structures, the lamp holder module and the LED illumination module are respectively located at two ends of the lamp body, and the plurality of foreign matter preventing structures are arranged between the transparent lamp cover and the lamp body and between the lamp body and the lamp holder module.

6. The modular lighting device according to claim 4, wherein the lamp cup comprises an outer surface and an inner surface opposed to the outer surface, and both of the outer surface and the inner surface are smooth surfaces, wherein the sensing device comprises a passive infrared human body sensor or a microwave sensor, wherein the LED illumination module is supported on the installation plane of the lamp body and coupled to the middle sleeve, wherein the modular lighting device further comprises a lamp holder module, the lamp holder module and the LED illumination module are respectively located at two ends of the lamp body, the lamp holder module comprises a second engaging structure, and the lamp holder module is coupled to the lamp body through the second engaging structure.

7. The modular lighting device according to claim 4, wherein the lamp cup comprises an outer surface and an inner surface opposed to the outer surface, both of the outer surface and the inner surface are smooth surfaces, and the outer surface, the inner surface, the installation plane and the first engaging structure are integrally formed with each other or detachably coupled to each other, wherein the sensing and driving module further comprises a light-sheltering cover for enclosing the sensing device, and the sensing device comprises a passive infrared human body sensor, wherein the transparent lamp cover comprises an opening at a top end and a lens, the light-sheltering cover is embedded into the opening, and the light-sheltering cover is capped by the lens, wherein the modular lighting device further comprises a lamp holder module, the lamp holder module and the LED illumination module are respectively located at two ends of the lamp body, the lamp holder module comprises a second engaging structure, and the lamp holder module is coupled to the lamp body through the second engaging structure.

8. The modular lighting device according to claim 4, wherein the lamp cup comprises an outer surface and an inner surface opposed to the outer surface, both of the outer surface and the inner surface are smooth surfaces, and the outer surface, the inner surface, the installation plane and the first engaging structure are integrally formed as a one-piece metal part or detachably coupled to each other, wherein the sensing and driving module further comprises a light-sheltering cover for enclosing the sensing device, and the sensing device comprises a passive infrared human body sensor, wherein the transparent lamp cover comprises an opening at a top end and a lens, the light-sheltering cover is embedded into the opening, and the light-sheltering cover is capped by the lens, wherein the modular lighting device further comprises a lamp holder module, the lamp holder module and the LED illumination module are respectively located at two ends of the lamp body, the lamp holder module comprises a second engaging structure, and the lamp holder module is coupled to the lamp body through the second engaging structure, wherein the modular lighting device further comprises a plurality of foreign matter preventing structures, and the plurality of foreign matter preventing structures are arranged between the transparent lamp cover and the lamp body and between the lamp body and the lamp holder module.

9. The modular lighting device according to claim 4, wherein the lamp cup comprises an outer surface and an inner surface opposed to the outer surface, both of the outer surface and the inner surface are smooth surfaces, and the outer surface, the inner surface, the installation plane and the first engaging structure are integrally formed as a one-piece metal part or detachably coupled to each other, wherein the sensing and driving module further comprises a coupling element for coupling the sensing device with the middle sleeve, and the sensing device comprises a microwave sensor, wherein the modular lighting device further comprises a lamp holder module, the lamp holder module and the LED illumination module are respectively located at two ends of the lamp body, the lamp holder module comprises a second engaging structure, and the lamp holder module is coupled to the lamp body through the second engaging structure, wherein the modular lighting device further comprises a plurality of foreign matter preventing structures, and the plurality of foreign matter preventing structures are arranged between the transparent lamp cover and the lamp body and between the lamp body and the lamp holder module.

10. The modular lighting device according to claim 4, wherein the lamp cup comprises an outer surface and an inner surface opposed to the outer surface, both of the outer surface and the inner surface are smooth surfaces, and the outer surface, the inner surface, the installation plane and the first engaging structure are integrally formed as a one-piece metal part or detachably coupled to each other, wherein the sensing and driving module further comprises a light-sheltering cover for enclosing the sensing device, and the sensing device comprises a passive infrared human body sensor, wherein the modular lighting device further comprises a lamp holder module, the lamp holder module and the LED illumination module are respectively located at two ends of the lamp body, the lamp holder module comprises an inner tube and a conductive outer casing, and the conductive outer casing is sheathed around the inner tube, wherein the modular lighting device further comprises a plurality of waterproof sealing rings, and the plurality of waterproof sealing rings are arranged between the transparent lamp cover and the lamp body and between the lamp body and the lamp holder module.

11. A modular lighting device with the heat dissipation module according to claim 2, the modular lighting device comprising:

a lamp cup included in the lamp body, wherein the lamp cup comprises an installation plane with a hollow part, and the installation plane comprises a first engaging structure; and a sensing and driving module comprising the circuit board and a sensing device, wherein the sensing device is penetrated through the hollow part of the installation plane and protruded over the installation plane, wherein the LED illumination module is supported on the installation plane of the lamp body, and the transparent lamp cover is coupled to the lamp body through the first engaging structure.

12. The modular lighting device according to claim 11, wherein the lamp cup comprises an outer surface and an inner surface opposed to the outer surface, and both of the outer surface and the inner surface are smooth surfaces; or wherein the sensing and driving module further comprises a light-sheltering cover for enclosing the sensing device, and the sensing device comprises a passive infrared human body sensor; or wherein the LED illumination module is supported on the installation plane and coupled to the middle sleeve; or wherein the modular lighting device further comprises a lamp holder module, the lamp holder module and the LED illumination module are respectively located at two ends of the lamp body, the lamp holder module comprises a second engaging structure, and the lamp holder module is coupled to the lamp body through the second engaging structure; or wherein the modular lighting device further comprises a lamp holder module and a plurality of foreign matter preventing structures, the lamp holder module and the LED illumination module are respectively located at two ends of the lamp body, and the plurality of foreign matter preventing structures are arranged between the transparent lamp cover and the lamp body and between the lamp body and the lamp holder module.

13. The modular lighting device according to claim 11, wherein the lamp cup comprises an outer surface and an inner surface opposed to the outer surface, and both of the outer surface and the inner surface are smooth surfaces, wherein the sensing device comprises a passive infrared human body sensor or a microwave sensor, wherein the LED illumination module is supported on the installation plane of the lamp body and coupled to the middle sleeve, wherein the modular lighting device further comprises a lamp holder module, the lamp holder module and the LED illumination module are respectively located at two ends of the lamp body, the lamp holder module comprises a second engaging structure, and the lamp holder module is coupled to the lamp body through the second engaging structure.

14. The modular lighting device according to claim 11, wherein the lamp cup comprises an outer surface and an inner surface opposed to the outer surface, both of the outer surface and the inner surface are smooth surfaces, and the outer surface, the inner surface, the installation plane and the first engaging structure are integrally formed with each other or detachably coupled to each other, wherein the sensing and driving module further comprises a light-sheltering cover for enclosing the sensing device, and the sensing device comprises a passive infrared human body sensor, wherein the transparent lamp cover comprises an opening at a top end and a lens, the light-sheltering cover is embedded into the opening, and the light-sheltering cover is capped by the lens, wherein the modular lighting device further comprises a lamp holder module, the lamp holder module and the LED illumination module are respectively located at two ends of the lamp body, the lamp holder module comprises a second engaging structure, and the lamp holder module is coupled to the lamp body through the second engaging structure.

15. The modular lighting device according to claim 11, wherein the lamp cup comprises an outer surface and an inner surface opposed to the outer surface, both of the outer surface and the inner surface are smooth surfaces, and the outer surface, the inner surface, the installation plane and the first engaging structure are integrally formed as a one-piece metal part or detachably coupled to each other, wherein the sensing and driving module further comprises a light-sheltering cover for enclosing the sensing device, and the sensing device comprises a passive infrared human body sensor, wherein the transparent lamp cover comprises an opening at a top end and a lens, the light-sheltering cover is embedded into the opening, and the light-sheltering cover is capped by the lens, wherein the modular lighting device further comprises a lamp holder module, the lamp holder module and the LED illumination module are respectively located at two ends of the lamp body, the lamp holder module comprises a second engaging structure, and the lamp holder module is coupled to the lamp body through the second engaging structure, wherein the modular lighting device further comprises a plurality of foreign matter preventing structures, and the plurality of foreign matter preventing structures are arranged between the transparent lamp cover and the lamp body and between the lamp body and the lamp holder module.

16. The modular lighting device according to claim 11, wherein the lamp cup comprises an outer surface and an inner surface opposed to the outer surface, both of the outer surface and the inner surface are smooth surfaces, and the outer surface, the inner surface, the installation plane and the first engaging structure are integrally formed as a one-piece metal part or detachably coupled to each other, wherein the sensing and driving module further comprises a coupling element for coupling the sensing device with the middle sleeve, and the sensing device comprises a microwave sensor, wherein the modular lighting device further comprises a lamp holder module, the lamp holder module and the LED illumination module are respectively located at two ends of the lamp body, the lamp holder module comprises a second engaging structure, and the lamp holder module is coupled to the lamp body through the second engaging structure, wherein the modular lighting device further comprises a plurality of foreign matter preventing structures, and the plurality of foreign matter preventing structures are arranged between the transparent lamp cover and the lamp body and between the lamp body and the lamp holder module.

17. The modular lighting device according to claim 11, wherein the lamp cup comprises an outer surface and an inner surface opposed to the outer surface, both of the outer surface and the inner surface are smooth surfaces, and the outer surface, the inner surface, the installation plane and the first engaging structure are integrally formed as a one-piece metal part or detachably coupled to each other, wherein the sensing and driving module further comprises a light-sheltering cover for enclosing the sensing device, and the sensing device comprises a passive infrared human body sensor, wherein the modular lighting device further comprises a lamp holder module, the lamp holder module and the LED illumination module are respectively located at two ends of the lamp body, the lamp holder module comprises an inner tube and a conductive outer casing, and the conductive outer casing is sheathed around the inner tube, wherein the modular lighting device further comprises a plurality of waterproof sealing rings, and the plurality of waterproof sealing rings are arranged between the transparent lamp cover and the lamp body and between the lamp body and the lamp holder module.

18. A modular lighting device with the heat dissipation module according to claim 3, the modular lighting device comprising:

a lamp cup included in the lamp body, wherein the lamp cup comprises an installation plane with a hollow part, and the installation plane comprises a first engaging structure; and a sensing and driving module comprising the circuit board and a sensing device, wherein the sensing device is penetrated through the hollow part of the installation plane and protruded over the installation plane, wherein the LED illumination module is supported on the installation plane of the lamp body, and the transparent lamp cover is coupled to the lamp body through the first engaging structure.

19. The modular lighting device according to claim 18, wherein the lamp cup comprises an outer surface and an inner surface opposed to the outer surface, and both of the outer surface and the inner surface are smooth surfaces; or wherein the sensing and driving module further comprises a light-sheltering cover for enclosing the sensing device, and the sensing device comprises a passive infrared human body sensor; or wherein the LED illumination module is supported on the installation plane and coupled to the middle sleeve; or wherein the modular lighting device further comprises a lamp holder module, the lamp holder module and the LED illumination module are respectively located at two ends of the lamp body, the lamp holder module comprises a second engaging structure, and the lamp holder module is coupled to the lamp body through the second engaging structure; or wherein the modular lighting device further comprises a lamp holder module and a plurality of foreign matter preventing structures, the lamp holder module and the LED illumination module are respectively located at two ends of the lamp body, and the plurality of foreign matter preventing structures are arranged between the transparent lamp cover and the lamp body and between the lamp body and the lamp holder module.

20. The modular lighting device according to claim 18, wherein the lamp cup comprises an outer surface and an inner surface opposed to the outer surface, and both of the outer surface and the inner surface are smooth surfaces, wherein the sensing device comprises a passive infrared human body sensor or a microwave sensor, wherein the LED illumination module is supported on the installation plane of the lamp body and coupled to the middle sleeve, wherein the modular lighting device further comprises a lamp holder module, the lamp holder module and the LED illumination module are respectively located at two ends of the lamp body, the lamp holder module comprises a second engaging structure, and the lamp holder module is coupled to the lamp body through the second engaging structure.

* * * * *